US005188895A

United States Patent [19]

Nishino et al.

[11] Patent Number: 5,188,895

[45] Date of Patent: Feb. 23, 1993

[54] SPLIT FIBERS, INTEGRATED SPLIT FIBER ARTICLES AND METHOD FOR PREPARING THE SAME

[75] Inventors: Kazunari Nishino; Shuzo Sasagawa, both of Kuga; Hirofumi Katsurayama, Inabe; Takamitsu Igaue; Tsutomu Kido, both of Kawanoe, all of Japan

[73] Assignees: Mitsui Petrochemical Industries, Ltd., Tokyo; Uni Charm Corporation, Kawanoe, both of Japan

[21] Appl. No.: 574,137

[22] Filed: Aug. 29, 1990

[30] Foreign Application Priority Data

Aug. 31, 1989 [JP] Japan ..... 1-225765

[51] Int. Cl.[5] ..... B32B 27/14; B29D 9/00; D01D 5/42

[52] U.S. Cl. ..... 428/373; 428/357; 428/359; 428/364; 428/375; 428/374; 264/147; 264/171

[58] Field of Search ..... 428/357, 359, 364, 373; 264/147, 171

[56] References Cited

U.S. PATENT DOCUMENTS 3,819,769 6/1974 Pirot ..... 260/897

4,134,951 1/1979 Dow et al. ..... 264/147

FOREIGN PATENT DOCUMENTS 0244486 11/1987 European Pat. Off. .

0262230 4/1988 European Pat. Off. .

OTHER PUBLICATIONS

Database WPIL, accesion No. 89-329610 (45) Derwent Publ. Ltd. 1989.

*Primary Examiner*—Patrick J. Ryan

*Assistant Examiner*—Richard C. Weisberger

*Attorney, Agent, or Firm*—Sherman and Shalloway

[57] ABSTRACT

Bulky split fibers having bond strength are produced by preparing a composite synthetic resin film of three layer structure having a polypropylene layer formed of a polypropylene/polyethylene blend and a polyethylene layer on either surface of the polypropylene layer, slitting and stretching the composite film to thereby form stretched tapes, and causing splitting of the stretched tapes for fibrillation. An integral article is prepared from the resultant split fibers by mixing them alone or with plant fibers and then heating at a temperature between the melting points of polyethylene and polypropylene, thereby integrating together the split fibers with each other or with the plant fibers.

4 Claims, No Drawings

SPLIT FIBERS, INTEGRATED SPLIT FIBER ARTICLES AND METHOD FOR PREPARING THE SAME

FIELD OF THE INVENTION

This invention relates to split fibers and more particularly, to split fibers which exhibit minimal powdering during fibrillation, the split fibers providing an integrated split fiber article having a high bond strength and dimensional stability. It also relates to a method for preparing the same.

BACKGROUND OF THE INVENTION

Fibers having combined two types of synthetic resin having different properties are known as composite fibers which are chemical fibers having crimpability and a fibril structure. One prior art method for preparing such composite fibers involves the steps of stretching and then slitting a composite synthetic resin film of two layer structure consisting of two materials having different properties, for example, two layers of polypropylene and polyethylene, thereby forming stretched tapes and fibrillating the stretched tapes into split fibers as disclosed in Japanese patent application Kokai No. 149905/1987.

Split fibers or yarns obtained by fibrillation of prior art known composite synthetic resin films, however, are undesirably susceptible to delamination while composite synthetic resin films are liable to layer separation during stretching. For example, composite synthetic resin films consisting of polypropylene and polyethylene layers suffered from the powdering problem that polyethylene is separated away upon fibrillation.

Some of the present inventors proposed in Japanese patent application No. 48223/1988 filed Mar. 1, 1988 (Japanese patent application Kokai No. 221507/1989), a method for preparing split fibers having improved crimpability and a fibril structure using a composite synthetic resin film having improved interlaminar bonding and stretchability while minimizing powdering during fibrillation as well as an integrated split fiber article of network structure formed from such split fibers. More particularly, the method for preparing split fibers includes the steps of: slitting and then stretching or stretching and then slitting a composite synthetic resin film having at least two layers, thereby forming stretched tapes, and fibrillating the stretched tapes into split fibers, characterized in that the composite synthetic resin film is a composite synthetic resin film in which one layer is a polypropylene layer formed of a mixture of 70 to 95% by weight of a polypropylene having a melt index of 0.5 to 10 and 30 to 5% by weight of a polyethylene having a melt index of 0.5 to 20 and the other layer is a polyethylene layer formed of a mixture of 70 to 95% by weight of a polyethylene having a melt index of 0.5 to 20 and 30 to 5% by weight of a polypropylene having a melt index of 0.5 to 10.

Also proposed in the last application is a method for preparing an integrated split fiber article, comprising the steps of: slitting and then stretching or stretching and then slitting a composite synthetic resin film having at least two layers, thereby forming stretched tapes, fibrillating the stretched tapes into split fibers, mixing the resultant split fibers alone or with plant fibrous material, and heating the mixture at a temperature between the melting points of the polyethylene and the polypropylene, thereby integrating together the split fibers with each other or with the plant fibrous material.

In mixing such split fibers alone or with plant fibers as typified by pulp and thermally fusing the split fibers together or with the plant fibers, especially under a substantially no pressure condition, the bond strength between split fibers or between split fibers and plant fibers is not necessarily sufficient because the polyethylene of the polyethylene layer forming the split fibers has poor melt flow and is susceptible to thermal shrinkage. Bond strength is low particularly when split fibers are integrated with plant fibers. In addition, the integrated split fiber article itself undergoes thermal shrinkage, leaving a room for improving dimensional stability.

SUMMARY OF THE INVENTION

Therefore, an object of the present invention is to provide a split fiber while minimizing powdering during fibrillation, the split fibers providing an integrated split fiber article having a high bond strength and dimensional stability. Another object of the present invention is to provide an integrated article from such split fibers.

The present invention provides a split fiber obtained from at least a composite synthetic resin film of three layer structure having a polypropylene layer and a polyethylene layer on either surface of the polypropylene layer, wherein said polypropylene layer comprises a mixture of 70 to 95% by weight of a polypropylene having a melt flow rate of 0.5 to 10 grams/10 minutes and 30 to 5% by weight of a polyethylene having a density of 0.93 to 0.96 g/cm$^3$ and said polyethylene layer comprises a polyethylene having a density of 0.93 to 0.96 g/cm$^3$ and a melt flow rate of at least 13 grams/10 minutes.

According to another aspect of the present invention, there is provided an integrated split fiber article obtained from the split fiber mentioned above. And there is provided another integrated split fiber article which has further plant fibrous material. If desired, a fibrous material other than the plant fibrous material or hygroscopic polymer may be added to the split fibers along with the plant fibrous material.

DETAILED DESCRIPTION OF THE INVENTION

First, the method for preparing split fibers or yarns according to the invention is described.

Preparation of split fibers starts from preparation of a composite synthetic resin film or sheet. The composite synthetic resin film is of the three layer structure consisting essentially of a first polyethylene layer, a second polypropylene layer, and a third polyethylene layer. More particularly, the composite synthetic resin film of three layer structure used herein has polyethylene layers as the first and third layers and a polypropylene base layer formed of a mixture of 70 to 95% by weight of polypropylene and 30 to 5% by weight of polyethylene, preferably a mixture of 80 to 92% by weight of polypropylene and 20 to 8% by weight of polyethylene.

The polyethylene of which the first and third layers are formed may be the same or different from each other and may be polyethylene alone or a mixture of polyethylene with any other resin which does not substantially affect the high melt flow and low thermal shrinkage of polyethylene. If the other resin is polypropylene, interlaminar bonding is not impaired, but rather somewhat improved. Therefore, the use of a mixture of polyethylene and polypropylene forms one preferred embodiment.

The polyethylene of which the first and third layers are formed and the polyethylene of which the second layer is partially formed should preferably have properties falling within the same range for minimized powdering, although such a choice is not critical.

The polypropylene of which the second layer is predominantly formed is a polypropylene having a melt flow rate (MFR) of 0.5 to 10 grams/10 minutes, preferably 2 to 8 grams/10 minutes, as measured by JIS K-6760.

The polyethylene of which the first and third layers are formed has a density of 0.93 to 0.96 g/cm$^3$, preferably 0.93 to 0.95 g/cm$^3$ and a melt flow rate (MFR) of at least 13 grams/10 minutes, preferably at least 20 grams/10 minutes. In turn, the polyethylene which is blended with polypropylene to form the second layer preferably has a density equal to the polyethylene of the first and third layer within the range of from 0.93 to 0.96 g/cm$^3$. However, the second layer-forming polyethylene need not be limited to an identical one to the first and third layer-forming polyethylene as long as they are of approximately identical quality as represented by a difference in density between them falling within 0.02 g/cm$^3$.

The composite synthetic resin film used herein consists of a first polyethylene layer, a second polypropylene layer and a third polyethylene layer wherein a polyethylene having a high melt flow rate is used as the first and third layers and a mixture of a polyethylene of approximately identical quality and the majority of a polypropylene is used as the second layer. The adhesion between the first and second layers and between the second and third layers are high enough to prevent powdering during fibrillation of stretched tapes of the composite synthetic resin film. The polyethylene of the first and third layers of split fibers has high melt flow, is wettable to plant fibrous material, and undergoes minimal thermal shrinkage or minimal shrinkage stress. Consequently, the split fibers can be formed into an integrated article having improved dimensional stability, minimized area shrinkage factor, and improved bond strength. Further, since the split fibers are of the three layer structure in which the inner layer of polypropylene is sandwiched between the outer layers of polyethylene having a high melt flow rate, there is available an increased bond area between the split fibers or between the split fibers and plant fibers, also contributing to the preparation of an integrated split fiber article having improved bond strength.

Interlaminar bonding will be discussed in further detail. In the above-cited application (Japanese patent application No. 48223/1988), the composite synthetic resin film is disclosed as comprising a polypropylene layer formed of a polypropylene composition containing 5 to 30% by weight of polyethylene and a polyethylene layer formed of a polyethylene composition containing 5 to 30% by weight of polypropylene. Interlaminar bonding is enhanced by forming both the layers from mixtures of polypropylene and polyethylene.

We have discovered that for a particular polyethylene layer, practically satisfactory interlaminar bonding is achieved simply by incorporating 5 to 30% by weight of polyethylene into the polypropylene layer. The present invention eliminates the need to incorporate polyethylene and polypropylene into polypropylene and polyethylene layers, respectively, as in the above-cited application.

In addition to polypropylene and polyethylene which are the major components of the composite synthetic resin film, any desired other additives including resins, pigments, dyes, lubricants, UV absorbers, and flame retardants may be used insofar as the objects of the invention are achieved.

Now, the preparation of split fibers is described. The composite synthetic resin film is prepared by any prior art well-known film forming methods including melt extrusion, calendering, and casting. Blown-film extrusion (or inflation) and T-die extrusion are preferred.

Total thickness of the composite synthetic resin film is generally in the range of from 20 to 300 μm, preferably from 30 to 100 μm.

The thus prepared composite synthetic resin film is slit and then stretched or stretched and then slit to thereby form stretched tapes or strips. The stretching is made by a factor of about 3 to 10, so that, for example, the total thickness of the composite synthetic resin film before the stretching (30 to 100 μm) becomes 15 to 40 μm after the stretching. The thickness of the first and third layers after the stretching is preferably 5 μm or thicker in view of the adhesion strength. The thickness of the intermediate second layer is preferably 5 μm or thicker in view of the heat resistance. For stretching of composite synthetic resin film, any prior art well-known stretching machines of hot roll, air oven and hot plate stretching systems may be used. Stretching temperature and factor vary with a stretching method, the type of composite synthetic resin film and other parameters. A stretching temperature of 97° to 138° C. and a stretching factor of 3 to 10 are preferred when a composite synthetic resin film is stretched using a hot roll, for example.

The stretched tape resulting from the slitting and stretching steps is then fibrillated or finely split into a bulk of split fibers having a fine network structure by passing the tape across a serrate knife edge or through needle-implanted rollers.

It is possible to form an integrated article from the network structure split fibers without additional treatment. Preferably, the network structure split fibers are further divided into shorter fibers by means of a cutter or the like before the fibers are integrated into an article. The short fibers are generally 1 to 100 mm long, preferably 5 to 50 mm long. Short fibers of 5 to 20 mm long are preferred when they are blended with plant fibrous material such as pulp. Each of the split fibers generally has a diameter of from several to several tens deniers ("denier" is a unit of filament thickness which is expressed as gram weight of filaments with 9000 m in total length). When it is desired to use such short split fibers, the split fibers are shortened through a certain treatment (for example, by an opener, cotton mixer or the like) so as to substantially reduce the network structure of split fibers. This is advantageous for uniform mixing with plant fibrous material, typically pulp.

The split fibers prepared by the above-mentioned method not only maintain the three layer structure having a high melt flow rate polyethylene layer on either surface of a polypropylene layer, but also have increased bulkiness since they have been finely split or fibrillated.

Next, an integrated article is prepared from split fibers, preferably finely split or short fibers as processed above. According to the invention, the integrated article is prepared either by mixing finely split fibers with each other, or by mixing finely split fibers with plant fibrous material and optionally at least one additive selected from fibrous materials other than the plant fibrous material and water absorbing polymers. A cotton mixer or similar mixing means may be used to this end.

The plant fibrous materials which can be used herein include cotton, flax, jute, hemp, and pulp. The mixing ratio of these plant fibrous materials in the total mixture is generally from 20 to 80% by weight, preferably from 30 to 70% by weight. The suitable additives include synthetic fibers (the contents are generally 50% by weight or lower) such as rayon, acetate and nylon and highly water absorbing polymers of starch and synthetic polymer types (the contents are generally 0.5 to 5% by weight).

The size of the plant fibrous material used herein varies with a particular application of an integrated article thereof although plant fibers having a length of 1 to 5 mm and a diameter of 5 to 15 μm are often used.

After split fibers are mixed with each other or with plant fibrous material, the mixture is heated to a temperature between the boiling points of polyethylene and polypropylene to fuse or integrate the split fibers with each other or with plant fibrous material, obtaining a bound article of split fibers. The heating temperature is generally in the range of from 100° to 160° C., preferably from 120° to 150° C.

The integrated article of split fibers is an article in which the split fibers are fused or bonded together. The integrated article of split fibers and plant fibrous material is an article in which the plant fibrous material and the additive, if any, are bound by the split fibers. Either of the integrated split fiber articles is well bondable to other materials and maintains its resiliency and bulkiness after bonding because the portion having a higher boiling point, that is, polypropylene can maintain its configuration during bonding. In addition, the integrated article does not lose stiffness when wetted because the split fibers are resistant to water. If split fibers which have been treated to be hydrophilic are used, there is obtained an integrated article having water absorbing nature.

There has been described a method for preparing split fibers of quality from a composite synthetic resin film while minimizing powdering during fibrillation. The split fibers can be integrated into an article having a high bond strength and dimensional stability. Since the split fibers prepared from a composite synthetic resin film are available as tangled yarn, both the split fibers and the integrated article thereof are characterized by bulkiness, fibril structure and resiliency. Therefore, articles prepared from such split fibers or integrated articles thereof have bulkiness, voluminous appearance, soft touch and thermal insulation. Since the composite synthetic resin film composed of polypropylene and polyethylene layers is resistant to water, the resultant split fibers or integrated articles thereof lose stiffness in no way when wetted with water.

Because of these advantages, the split fibers or integrated articles thereof prepared by the present invention can find a wide variety of applications including non-woven fabrics, composite non-woven fabrics with pulp, interior materials such as curtains and rugs, apparel materials such as sweaters, absorbent materials such as diapers, vibration damping materials, exterior materials, and packaging materials. It will be understood that when the split fibers or integrated articles thereof according to the invention are used as absorbent materials such as diapers, water absorbing polymers are preferably added thereto.

EXAMPLES

Examples of the present invention are given below by way of illustration and not by way of limitation.

EXAMPLE 1

A composite synthetic resin film was prepared from polypropylene and polyethylene resins. The polypropylene resin used to form a center layer of the composite film was prepared by mixing 90 parts by weight of a polypropylene having a melt flow rate of 2.4 grams/10 minutes and 10 parts by weight of a polyethylene having a density of 0.945 g/cm$^3$ and a melt flow rate of 20 grams/10 minutes.

The same polyethylene as above was used as a polyethylene resin to form outer layers.

Using 50 parts by weight of the polypropylene resin and 50 parts by weight of the polyethylene resin, the composite synthetic resin film was prepared under the following conditions.

COMPOSITE SYNTHETIC RESIN FILM PREPARING PARAMETERS

Inflation Extruder

Die diameter: 300 mm
Screens:,
80 mesh, 100 mesh,
150 mesh, 200 mesh,
100 mesh, 80 mesh
Film forming rate: 14 m/min.
Film tension take-up speed: 102 m/min.

| | Temperature profile | | | | | |
|---|---|---|---|---|---|---|
| | Temperature (°C.) | | | | | |
| | Cylinder | | | Adapter | Die | |
| | C1 | C2 | C3 | AD | D1 | D2 |
| 1st layer, 3rd layer | 180 | 200 | 200 | 180 | 200 | 200 |
| 2nd layer | 200 | 230 | 230 | 230 | 200 | 200 |

Then the composite synthetic film was slit and stretched into a stretched tape which was finely split for fibrillation. The split fibers were examined for powdering during fibrillation, area shrinkage factor of the polyethylene layer, and bond strength.

Powdering

The composite film was slit to a width of 30 mm and then stretched by a factor of 7.3. The stretched tape was split by a serrate knife edge. Powder deposition was observed during the process.

Area Shrinkage Factor

A sheet having a weight of 300 g/m$^2$ was formed by mixing 50 parts by weight of 10-mm short fibers split by means of a cutter as above and 50 parts by weight of pulp in a cotton mixer followed by sheet forming. The pulp used was IP SUPER SOFT (trade name) originated from a southern pine tree, with mean fiber length being 2.5 mm. The sheet was cut into square pieces of 20 cm by 20 cm. The square pieces were heat treated by blowing hot air at 135° C. to both the surfaces of the pieces at a velocity of 1.5 m/sec. The area of the pieces was measured again to determine an area shrinkage factor.

Bond Strength

Square pieces of a short fiber/pulp blend were prepared and heat treated by the same procedure as above. The samples were cut into strips of 20 cm long by 25 mm wide. Each strip was measured for rupture strength using a tensile tester, Tensilon (Shimazu Mfg. K.K.) at a chuck-to-chuck span of 10 cm and a pulling speed of 300 mm/min.

The results are shown in Table 1.

EXAMPLE 2

Split fibers and an integrated split fiber article (sheet) were prepared and examined by the same procedures as in Example 1 except that a polyethylene having a density of 0.950 g/cm$^3$ and a melt flow rate of 30 grams/10 minutes was used as the polyethylene blended in the polypropylene resin of the center layer and as the polyethylene resin of the outer layers.

The results are shown in Table 1.

EXAMPLE 3

Split fibers and an integrated split fiber article (sheet) were prepared and examined by the same procedures as in Example 1 except that a polyethylene having a density of 0.935 g/cm$^3$ and a melt flow rate of 25 grams/10 minutes was used as the polyethylene blended in the polypropylene resin of the center layer and as the polyethylene resin of the outer layers.

The results are shown in Table 1.

EXAMPLE 4

Split fibers and an integrated split fiber article (sheet) were prepared and examined by the same procedures as in Example 1 except that a polyethylene having a density of 0.935 g/cm$^3$ and a melt flow rate of 21 grams/10 minutes was used as the polyethylene blended in the polypropylene resin of the center layer and as the polyethylene resin of the outer layers.

The results are shown in Table 1.

EXAMPLE 5

Split fibers and an integrated split fiber article (sheet) were prepared and examined by the same procedures as in Example 2 except that the polypropylene resin of the center layer contained 95 parts by weight of the polypropylene and 5 parts by weight of the polyethylene.

The results are shown in Table 1.

EXAMPLE 6

Split fibers and an integrated split fiber article (sheet) were prepared and examined by the same procedures as in Example 2 except that the polypropylene resin of the center layer contained 75 parts by weight of the polypropylene and 25 parts by weight of the polyethylene.

The results are shown in Table 1.

The sheet before the heat treatment had a density of $10\times10^{-3}$ g/cm$^3$ to $15\times10^{-3}$ g/cm$^3$ and was fluffy and cushion-like. The sheet after the heat treatment having an area shrinkage factor of 10% had a density of $30\times10^{-3}$ g/cm$^3$ to $50\times10^{-3}$ g/cm$^3$ and was soft to the touch. Its bending resistance was 10 to 20. The bending resistance was measured according to the Japanese Industrial Standard P-8125 which is a testing method to measure bending strength of boards by means of a load bending method.

EXAMPLE 7

Split fibers and an integrated split fiber article (sheet) were prepared and examined by the same procedures as in Example 1 except that the article was prepared from the split fibers only while the pulp was omitted.

The results are shown in Table 1.

EXAMPLE 8

Split fibers and an integrated split fiber article (sheet) were prepared and examined by the same procedures as in Example 2 except that the article was prepared from the split fibers only while the pulp was omitted.

The results are shown in Table 1.

COMPARATIVE EXAMPLE 1

Split fibers and an integrated split fiber article (sheet) were prepared and examined by the same procedures as in Example 1 except that a polyethylene having a density of 0.935 g/cm$^3$ and a melt flow rate of 1 grams/10 minutes was used as the polyethylene blended in the polypropylene resin of the center layer and as the polyethylene resin of the outer layers.

The results are shown in Table 1.

COMPARATIVE EXAMPLE 2

Split fibers and an integrated split fiber article (sheet) were prepared and examined by the same procedures as in Example 1 except that a polyethylene having a density of 0.958 g/cm$^3$ and a melt flow rate of 0.4 grams/10 minutes was used as the polyethylene blended in the polypropylene resin of the center layer and as the polyethylene resin of the outer layers.

The results are shown in Table 1.

COMPARATIVE EXAMPLE 3

Split fibers and an integrated split fiber article (sheet) were prepared and examined by the same procedures as in Example 1 except that a polyethylene having a density of 0.918 g/cm$^3$ and a melt flow rate of 2 grams/10 minutes was used as the polyethylene blended in the polypropylene resin of the center layer and as the polyethylene resin of the outer layers.

The results are shown in Table 1.

COMPARATIVE EXAMPLE 4

Split fibers and an integrated split fiber article (sheet) were prepared and examined by the same procedures as in Example 1 except that a polyethylene having a density of 0.926 g/cm$^3$ and a melt flow rate of 22 grams/10 minutes was used as the polyethylene blended in the polypropylene resin of the center layer and as the polyethylene resin of the outer layers.

The results are shown in Table 1.

COMPARATIVE EXAMPLE 5

Split fibers and an integrated split fiber article (sheet) were prepared and examined by the same procedures as in Example 2 except that the center layer was formed from the polypropylene alone without blending polyethylene.

The results are shown in Table 1.

COMPARATIVE EXAMPLE 6

Split fibers and an integrated split fiber article (sheet) were prepared and examined by the same procedures as in Example 2 except that the polypropylene resin of the center layer contained 50 parts by weight of the polypropylene and 50 parts by weight of the polyethylene.

The results are shown in Table 1.

COMPARATIVE EXAMPLE 7

An integrated split fiber article (sheet) was prepared and examined by the same procedures as in Comparative Example 1 except that the article was prepared from the split fibers only while the pulp was omitted.

The results are shown in Table 1.

COMPARATIVE EXAMPLE 8

Split fibers and an integrated split fiber article (sheet) were prepared and examined by the same procedures as in Example 2 except that the composite synthetic resin film had a two layer structure consisting of a first layer of the polyethylene resin and a second layer of the polypropylene resin.

The results are shown in Table 1.

The density was $50\times10^{-3}$ g/cm$^3$ or higher with a hard touch and the bending resistance was 20 or higher when they were measured by the same procedure as in Example 6.

COMPARATIVE EXAMPLE 9

Split fibers and an integrated split fiber article (sheet) were prepared and examined by the same procedures as in Example 1 except that the composite synthetic resin film had a two layer structure consisting of a first polyethylene layer and a second polypropylene layer, and a polyethylene having a density of 0.965 g/cm$^3$ and a melt flow rate of 13 grams/10 minutes was used as the polyethylene blended in the polypropylene resin of the second layer and as the polyethylene resin of the first layer.

The results are shown in Table 1.

COMPARATIVE EXAMPLE 10

The procedure of Example 2 was repeated except that a polypropylene having a melt flow rate of 0.4 g/10 minutes was used. Rough texture deterred stretching.

COMPARATIVE EXAMPLE 11

The procedure of Example 2 was repeated except that a polypropylene having a melt flow rate of 15 g/10 minutes was used. No film could be formed due to a lack of melt tension during melting.

TABLE 1

| Example | Composite film layer structure | Center layer blend ratio PP | Center layer blend ratio PE | Polyethylene Density, g/cm$^3$ | Polyethylene MFR, g/10 min. | Powdering | Area shrinkage factor, % | Bond strength, g/25 mm |
|---|---|---|---|---|---|---|---|---|
| E1 | PE/PP/PE | 90 | 10 | 0.945 | 20 | No powder | 9 | 420 |
| E2 | PE/PP/PE | 90 | 10 | 0.950 | 30 | No powder | 6 | 505 |
| E3 | PE/PP/PE | 90 | 10 | 0.935 | 25 | No powder | 8 | 460 |
| E4 | PE/PP/PE | 90 | 10 | 0.935 | 21 | Some powdering | 10 | 340 |
| E5 | PE/PP/PE | 95 | 5 | 0.950 | 30 | Some powdering | 7 | 485 |
| E6 | PE/PP/PE | 75 | 25 | 0.950 | 30 | No powder | 10 | 510 |
| E7 | PE/PP/PE | 90 | 10 | 0.945 | 20 | No powder | 12 | 615 |
| E8 | PE/PP/PE | 90 | 10 | 0.950 | 30 | No powder | 4 | 1400 |
| CE1 | PE/PP/PE | 90 | 10 | 0.935 | 1 | Some powdering | 25 | 100 |
| CE2 | PE/PP/PE | 90 | 10 | 0.958 | 0.4 | No powder | 40 | 90 |
| CE3 | PE/PP/PE | 90 | 10 | 0.918 | 2 | Continuous powdering | 8 | 200 |
| CE4 | PE/PP/PE | 90 | 10 | 0.926 | 22 | Continuous powdering | 8 | 250 |
| CE5 | PE/PP/PE | 100 | 0 | 0.950 | 30 | Some or continuous powdering | 8 | 410 |
| CE6 | PE/PP/PE | 50 | 50 | 0.950 | 30 | No powder | 25 | 535 |
| CE7 | PE/PP/PE | 90 | 10 | 0.935 | 1 | Some powdering | 34 | 450 |
| CE8 | PE/PP | 90 | 10 | 0.950 | 30 | No powder | 19 | 260 |
| CE9 | PE/PP | 90 | 10 | 0.965 | 13 | No powder | 30 | 150 |
| CE10 | PE/PP/PE | 90 | 10 | 0.950 | 30 | Non-formable due to rough texture | | |
| CE11 | PE/PP/PE | 90 | 10 | 0.950 | 30 | Non-formable due to low melt tension | | |

Although some preferred embodiments have been described, many modifications and variations may be made thereto in the light of the above teachings. It is therefore to be understood that within the scope of the appended claims, the invention may be practiced otherwise than as specifically described.

We claim:

1. A split fiber composite synthetic resin film comprising a three layer structure having a polypropylene layer and a polyethylene layer on either surface of the polypropylene layer, wherein said polypropylene layer comprises a mixture of 70 to 95% by weight of a polypropylene having a melt flow rate of 0.5 to 10 grams/10 minutes and 30 to 5% by weight of a polyethylene having a density of 0.93 to 0.96 g/cm$^3$ and said polyethylene layer comprises a polyethylene having a density of 0.93 to 9.96 g/cm$^3$ and a melt flow rate of at least 13 grams/10 minutes.

2. A split fiber according to claim 1 wherein the polypropylene layer contains 30% to 5% by weight of a polyethylene having a density of 0.93 to 9.96 g/cm$^3$ and a melt flow rate of at least 13 grams/10 minutes.

3. A split fiber according to claim 1 wherein the propylene layer comprises a mixture of 80 to 92% by weight of polypropylene and 20 to 8% by weight of polyethylene.

4. A split fiber according to claim 1 wherein the polypropylene has a melt flow rate of 2 to 8 grams/10 minutes and the polyethylene layers each have a density of 0.93 to 0.95 g/cm$^3$ and a melt flow rate of at least 20 grams/10 minutes.

* * * * *